US007000407B2

(12) United States Patent
Miozza et al.

(10) Patent No.: US 7,000,407 B2
(45) Date of Patent: Feb. 21, 2006

(54) METHODS AND APPARATUS FOR CONTROLLING REFRIGERATORS

(75) Inventors: Debra Ann Miozza, Louisville, KY (US); Martin Zentner, Prospect, KY (US); Anand Ganesh Joshi, Karnataka State (IN); Sanjay Manohar Anikhindi, Karnataka (IN); Venkataramana Rachakonda, Hyderabad (IN); Venkata Ramakrishna Ramayanam, Louisville, KY (US); John Kenneth Hooker, Louisville, KY (US); Omar Haidar, Prospect, KY (US)

(73) Assignee: General Electric Company, Schenectady, NY (US)

( * ) Notice: Subject to any disclaimer, the term of this patent is extended or adjusted under 35 U.S.C. 154(b) by 49 days.

(21) Appl. No.: 10/443,158

(22) Filed: May 22, 2003

(65) Prior Publication Data

US 2004/0231339 A1 Nov. 25, 2004

(51) Int. Cl.
*F25B 21/02* (2006.01)

(52) U.S. Cl. ..... 62/3.2; 62/440

(58) Field of Classification Search ..... 62/3.2, 62/3.3, 3.6, 3.62, 3.64, 440
See application file for complete search history.

(56) References Cited

U.S. PATENT DOCUMENTS

| | | | | |
|---|---|---|---|---|
| 4,142,378 | A * | 3/1979 | Bright et al. | 62/135 |
| 5,474,213 | A * | 12/1995 | Unger | 222/108 |
| 5,608,643 | A * | 3/1997 | Wichter et al. | 700/244 |
| 5,690,849 | A * | 11/1997 | DeVilbiss et al. | 219/497 |
| 5,890,371 | A * | 4/1999 | Rajasubramanian et al. | 62/259.2 |
| 6,205,790 | B1 * | 3/2001 | Denkin et al. | 62/3.7 |
| 6,338,251 | B1 | 1/2002 | Ghoshal | |
| 6,351,955 | B1 * | 3/2002 | Oltman et al. | 62/71 |
| 2001/0035024 | A1 * | 11/2001 | Dasher et al. | 62/440 |
| 2002/0104325 | A1 * | 8/2002 | Mandel et al. | 62/187 |
| 2002/0184895 | A1 | 12/2002 | Anderson et al. | |

* cited by examiner

*Primary Examiner*—Melvin Jones
(74) *Attorney, Agent, or Firm*—H. Neil Houser, Esq.; Armstrong Teasdale LLP

(57) ABSTRACT

A refrigerator including a refrigerator compartment, a refrigerator door coupled to the refrigerator compartment, the refrigerator door has an inner surface. The refrigerator further includes a bin for storing items therein mounted to the inner surface of the refrigerator door and at least one thermoelectric module operationally coupled to the bin, such that the bin is temperature controlled independent of the refrigerator compartment.

21 Claims, 11 Drawing Sheets

METHODS AND APPARATUS FOR CONTROLLING REFRIGERATORS

BACKGROUND OF THE INVENTION

This invention relates generally to refrigerators, and more particularly, to a temperature controlled compartment in refrigerators.

Some known refrigerators include a fresh food compartment and a freezer compartment, each with their own respective compartment door. Such a refrigerator also typically includes a refrigeration sealed circuit including a compressor, an evaporator, and a condenser connected in series. An evaporator fan is provided to blow air over the evaporator, and a condenser fan is provided to blow air over the condenser.

In operation, when an upper temperature limit is reached in the freezer compartment, the compressor, evaporator fan, and condenser fan are energized. Once the temperature in the freezer compartment reaches a lower temperature limit, the compressor, evaporator fan, and condenser fan are de-energized.

Known refrigerators typically have control knobs to adjust fresh food and freezer compartment temperatures. At each combined setting of the control knobs, there is a target set of fresh food and freezer temperatures that an ideal refrigerator should achieve, independent of ambient conditions. However, fresh food and freezer compartments do not allow for a separate storage area within each compartment door that has a temperature which is controlled independently of the fresh food or freezer compartment temperatures.

BRIEF DESCRIPTION OF THE INVENTION

In one aspect, a refrigerator is provided. The refrigerator includes a refrigerator compartment, a refrigerator door coupled to the refrigerator compartment, the refrigerator door has an inner surface. The refrigerator further includes a bin for storing items therein mounted to the inner surface of the refrigerator door and at least one thermoelectric module operationally coupled to the bin, such that the bin is temperature controlled independent of the refrigerator compartment.

In another aspect, a bin mounted to an inner surface of a refrigerator door is provided. The bin includes a bin housing assembly having a bottom wall, a side wall, and a top wall, defining an inner surface of the bin, a bin door having an inner surface and an outer surface, and a linkage system coupling the bin door to the bin for moving the bin door between an open position and a closed position in a single vertical plane. The linkage system includes a first linkage member having a first end coupled to the inner surface of the side wall, and a second end coupled to the inner surface of the bin door, a first biasing member having a first end coupled to the inner surface of the side wall, and a second end coupled to the first linkage member, a second linkage member having a first end coupled to the inner surface of the side wall, and a second end coupled to the inner surface of the bin door, and a second biasing member having a first end coupled to an anchor member extending from the inner surface of the side wall, and a second end coupled to the second linkage member.

In another aspect, a bin mounted to an inner surface of a refrigerator door is provided. The bin includes a bin housing assembly having a bottom wall, a side wall, and a top wall defining an inner surface of the bin. A bin door coupled to the bin housing assembly by a hinge and a leaf spring system for moving the bin door between an open position and a closed position in a single vertical plane. The leaf spring system includes a leaf spring including a first end fixedly attached to the inner surface of the top wall and a second end including a curved tip at a distal end thereof. The leaf spring system further includes an arcuate hinge member extending from the hinge, the hinge member disposed between the leaf spring and the top wall so that the leaf spring applies a force on the hinge member.

In another aspect, a refrigerator is provided. The refrigerator includes a main refrigerator control system for controlling the temperature of the refrigerator compartment, a refrigerator door coupled to the refrigerator compartment by a hinge, the refrigerator door includes an inner surface, and a bin for storing items therein mounted to the inner surface of the refrigerator door. The bin is temperature controlled independently of the refrigerator compartment. The bin has a local bin control system for controlling the temperature within the bin. The local bin control system is electrically coupled to the main refrigerator control system through the hinge.

In another aspect, a method for operating a thermoelectric module is provided. The method includes providing a PWM controller and controlling the thermoelectric module with the PWM controller.

In a further aspect, a refrigerator is provided. The refrigerator includes a refrigerator compartment, a main refrigerator control system for controlling the temperature of the refrigerator compartment, a refrigerator door coupled to the refrigerator compartment by a hinge, the refrigerator door has an inner surface and an outer surface, and a bin for storing items therein mounted to the inner surface of the refrigerator door. The bin is temperature controlled independently of the refrigerator compartment. The bin has a local bin control system for controlling the temperature within the bin. The bin is further configured to provide a signal to the main refrigerator control system.

DETAILED DESCRIPTION OF THE INVENTION

Figure 1:
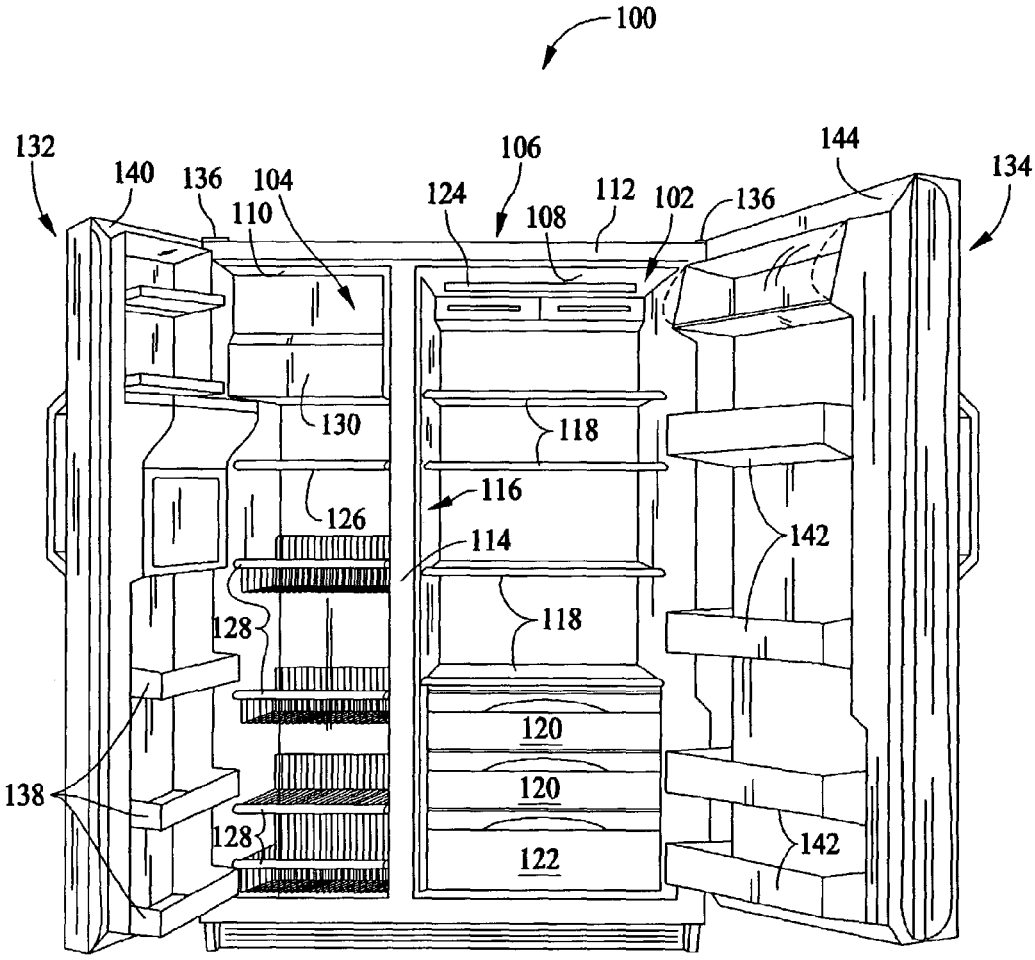
FIG. 1 is a perspective view of a refrigerator.

FIG. 1 illustrates a side-by-side refrigerator 100 including a fresh food storage compartment 102 and freezer storage compartment 104. Freezer compartment 104 and fresh food compartment 102 are arranged side-by-side. In one embodiment, refrigerator 100 is a commercially available refrigerator from General Electric Company, Appliance Park, Louisville, Ky. 40225, and is modified to incorporate the herein described methods and apparatus.

It is contemplated, however, that the teaching of the description set forth below is applicable to other types of refrigeration appliances, including but not limited to top and bottom mount refrigerators wherein undesirable temperature gradients exist. The present invention is therefore not intended to be limited to any particular type or configuration of a refrigerator, such as refrigerator 100.

Refrigerator 100 includes a fresh food storage compartment 102 and a freezer storage compartment 104 contained within an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls 230, 232 of case. A bottom wall 234 of case 106 normally is formed separately and attached to the case side walls 232 and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment 102.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116. Cold air is received from freezer compartment through a fresh food damper (not shown) in mullion.

Shelves 118 and slide-out drawers 120 normally are provided in fresh food compartment 102 to support items being stored therein. A bottom drawer or pan 122 may partly form a quick chill and thaw system (not shown) and selectively controlled, together with other refrigerator features, by a microprocessor (not shown in FIG. 1) according to user preference via manipulation of a main refrigerator control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown in FIG. 1), a condenser (not shown in FIG. 1), an expansion device (not shown in FIG. 1), and an evaporator (not shown in FIG. 1) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator 100 subject to the following control scheme.

Figure 2:
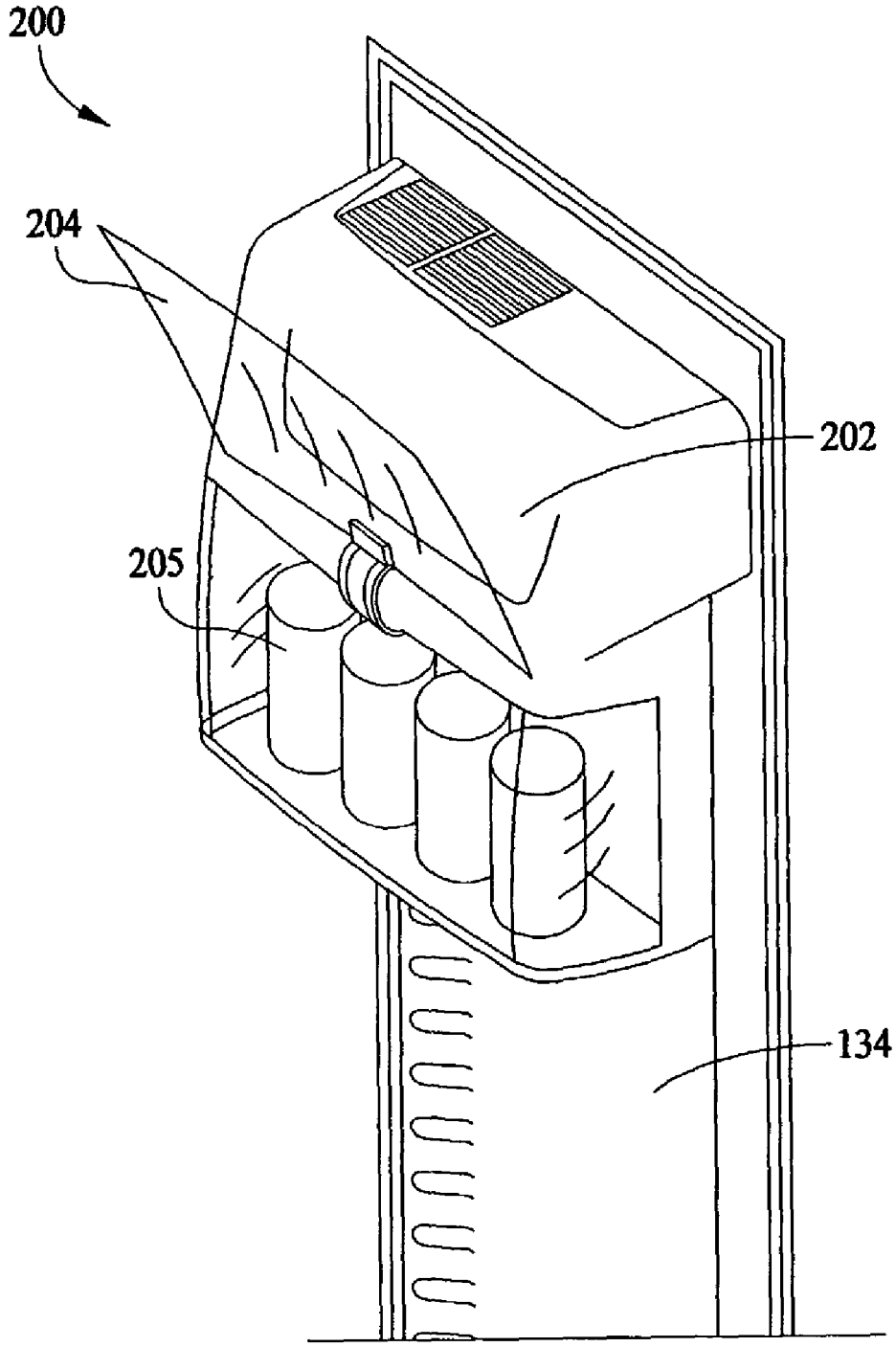
FIG. 2 is a perspective view of an exemplary storage compartment within the refrigerator of FIG. 1.

FIG. 2 is an exemplary embodiment of a bin 200 mounted to fresh food door 134. Bin 200 is a self contained temperature controlled storage compartment. A bin control interface 202 allows a user to chill quickly, thaw, or set the temperature for a particular item by inputting the desired temperature parameters on bin control interface 202. Bin 200 has a bin door 204 moveable between an open position and a closed position allowing access to contents 205 stored therein.

Figure 3:
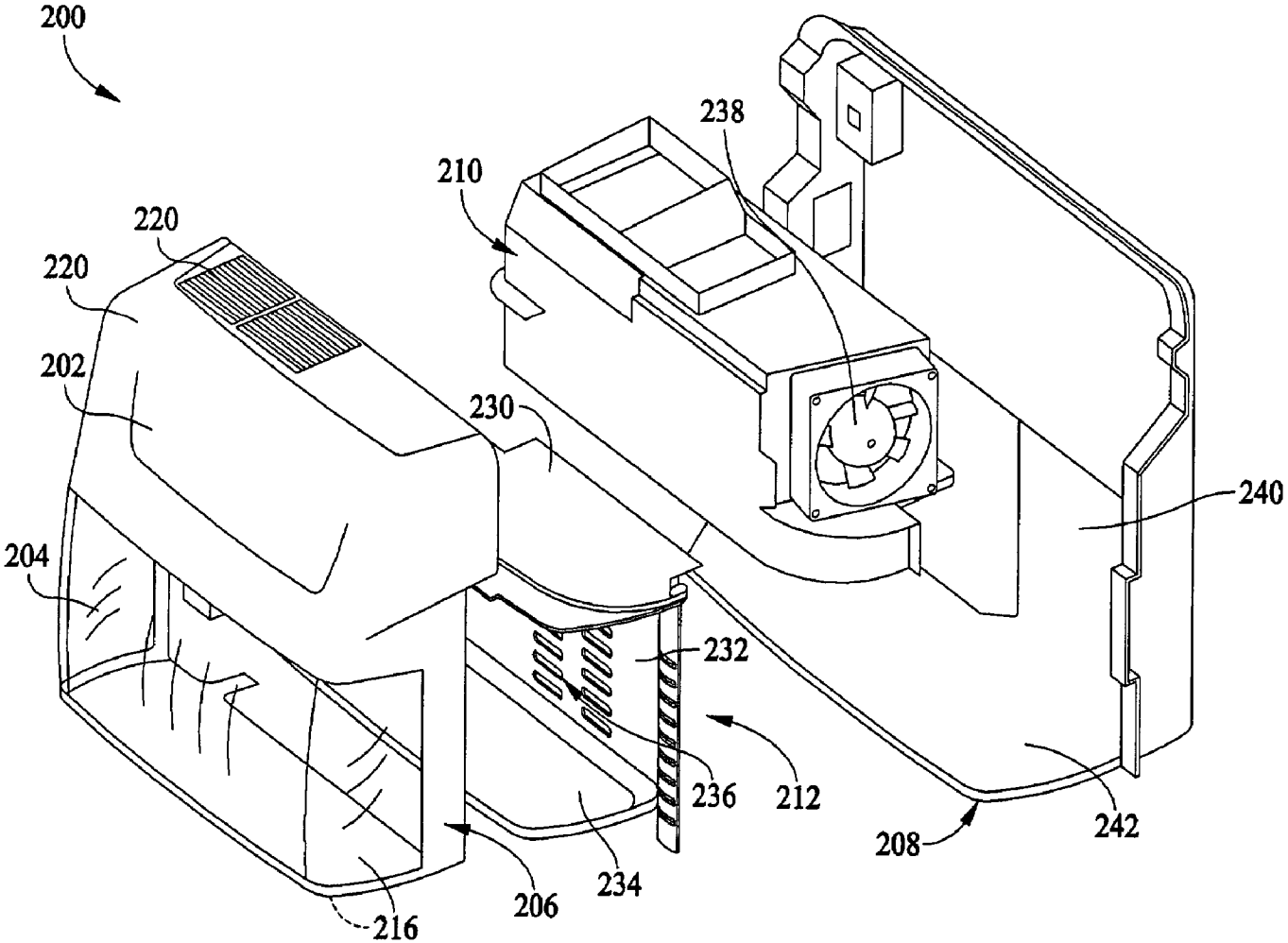
FIG. 3 is an exploded view of the storage compartment of FIG. 2.

FIG. 3 is an exploded view of bin 200. Bin 200 includes a front panel assembly 206, and a back panel assembly 208, which are coupled together to enclose a housing assembly 210 and a tray assembly 212. Front panel assembly 206 includes a tray assembly support section 216 and a housing assembly enclosure section 220. Housing assembly enclosure section 220 includes a vent 222 allowing venting to fresh food compartment 102. In the exemplary embodiment, bin door 204 and a portion of front panel assembly 206 are transparent, allowing the user to visually inspect contents 205 contained therein but may be opaque and be provided with pictures, graphics or decal.

Tray assembly 212 has a top wall 230, a side wall 232, and a bottom wall 234 defining an inner surface 236 for storing items within bin 200. Housing assembly 210 has a fan 238 for drawing air into or out of housing assembly 210. Tray assembly 212 is disposed within tray assembly support section 216. Housing assembly 210 is disposed within housing assembly enclosure section 220 and positioned on top wall 230 of tray assembly 212. Back panel assembly 208 has a back portion 240 and a support section 242 substantially perpendicular to back portion 240. Back portion 240 is mounted to fresh food door 134 and support section 242 provides structural support for front panel assembly 206, tray assembly 212, and housing assembly 210. The above described temperature controlled bin 200 components may be self contained and modular.

Figure 4:
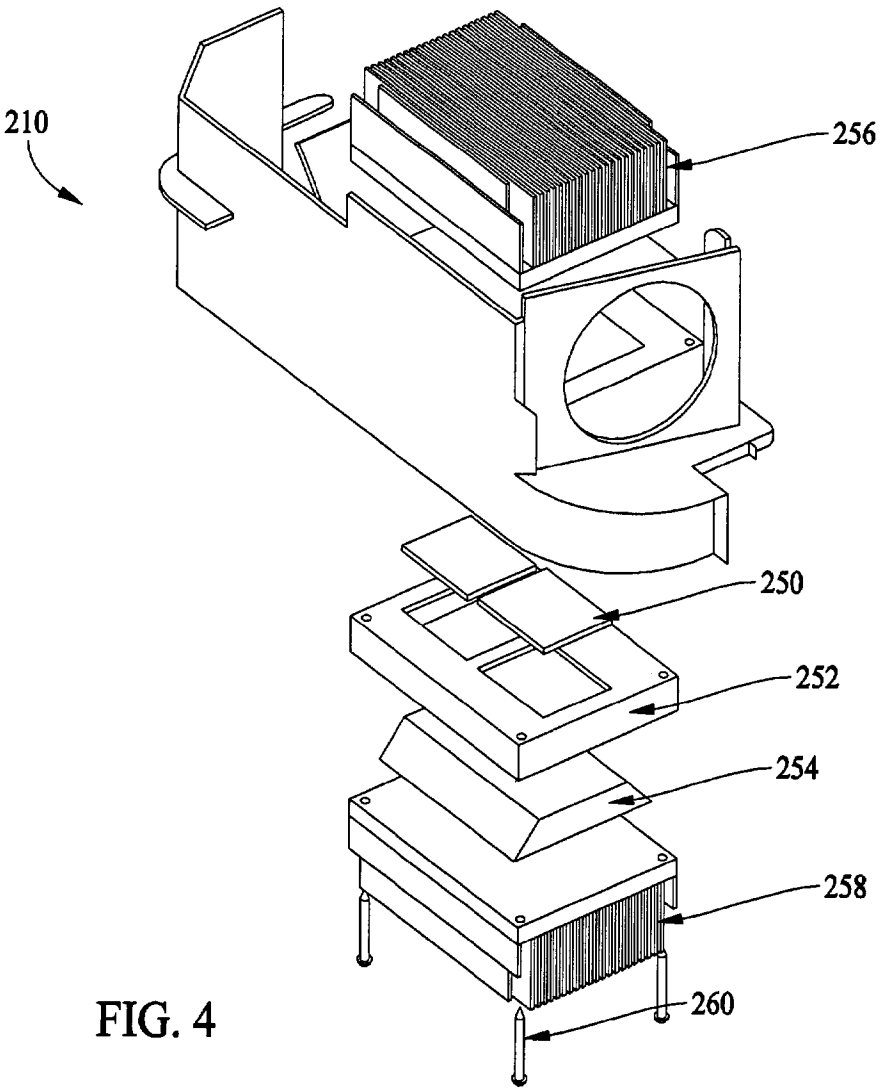
FIG. 4 is an exploded view of a housing assembly of the storage compartment of FIG. 2.

FIG. 4 is an exploded view of housing assembly 210. Housing assembly 210 has at least one thermoelectric (TE) module 250 coupled to an insulation layer 252, a block of thermally conductive material/metal 254, a hot side sink 256, and a cold side sink 258. Hot side sink 256, insulation layer 252, and cold side sink 258 are coupled together with at least one fastener 260. The block of thermally conductive material/metal 254 is disposed between insulation layer 252 and cold side sink 258. When TE module 250 is used to increase the temperature within bin 200, cold side sink 258 is physically on the hot side of TE module 250, and hot side sink is physically on the cold side of TE module 250.

Bin 200 temperature is controlled by bin control interface 202 using fan 238, heatsinks, thermoelectric modules 250, dampers, integrated controls and a combination of fresh food and recirculated air. Air is ducted through bin 200 and exchange with fresh food compartment 102 air or recirculating bin compartment 200 air using a damper system or a combination of refrigerator compartment 102 air and recirculating bin compartment 200 air based on pressure drops in the system. TE module 250 is reversible in controlling heat flow toward hot side sink 256 to decrease temperature within bin 200 or controlling heat flow away from hot side sink 256 to increase temperature within bin 200, thereby directing the flow of heat to hot side sink 256 to either warm or cool contents within bin 200. Control interface 202 allows a user to select from a quick chill mode, a quick thaw mode, and a set temperature mode. Another embodiment would also allow control of the fresh food 102 and freezer 104 temperatures. Power for the operation modes of bin 200 is supplied from refrigerator 100 as will be discussed in more detail below.

In the quick chill mode, bin damper is open to fresh food compartment 102. TE module 250 is turned on with a positive polarity so that cold side sink 258 cools bin 200 and fan 238 is turned on. This configuration is sustained for a particular period of time. Chill mode has varying levels of quick chill based on user input which determines the period of time that the system runs. If bin 200 is in the chill mode while fresh food door 134 is opened, the bin damper is closed and the fan stops or runs at a reduced speed. Closing bin damper helps to keep bin 200 cold while exposed to the warmer room temperature air. Once fresh food door 134 is closed, bin damper is opened. A suitable time delay between closing of fresh food compartment and opening of compartment damper may be provided to ensure that the warm air ingresses into fresh food compartment 102 (from fresh food door 134 opening) gets sufficiently cooled before it enters into fresh food compartment 102.

In the quick thaw mode, bin damper is closed to fresh food compartment 102 or a pressure drop in the system results in the compartment air recirculating while mixing with the fresh food air. TE module 250 is turned on with a negative polarity so that cold side sink 258 warms bin 200 and fan 238 is turned on. The temperature of bin 200 is controlled to a specific temperature using a thermistor as a feedback component. This topology allows different heating profiles to be applied to different package sizes. Thaw mode has varying levels of thaw based on user input which determines the package size selection. During the express thaw modes the user has the option to increase or decrease the operation time.

In the set temperature mode, the temperature of the air in bin 200 is compared to the user's selected temperature choice. Based on the temperature difference, bin 200 will operate in a chilling mode or a thawing mode until the selected temperature is approximately reached. During the select temperature mode, the user has the option to adjust the temperature colder or warmer from a pre-selected temperature chosen.

The set temperature mode has expanded capability in that it has preset options as well as a manual adjustment that can be made to the set temperature. This feature uses thermoelectric technology to control the temperature of a localized area within the temperature controlled environment of fresh food compartment 102. The independent controls are tied to the main refrigerator control interface 124 so that communication can be achieved for enhanced control, making the herein described methods and apparatus modular and independent.

Figure 5:
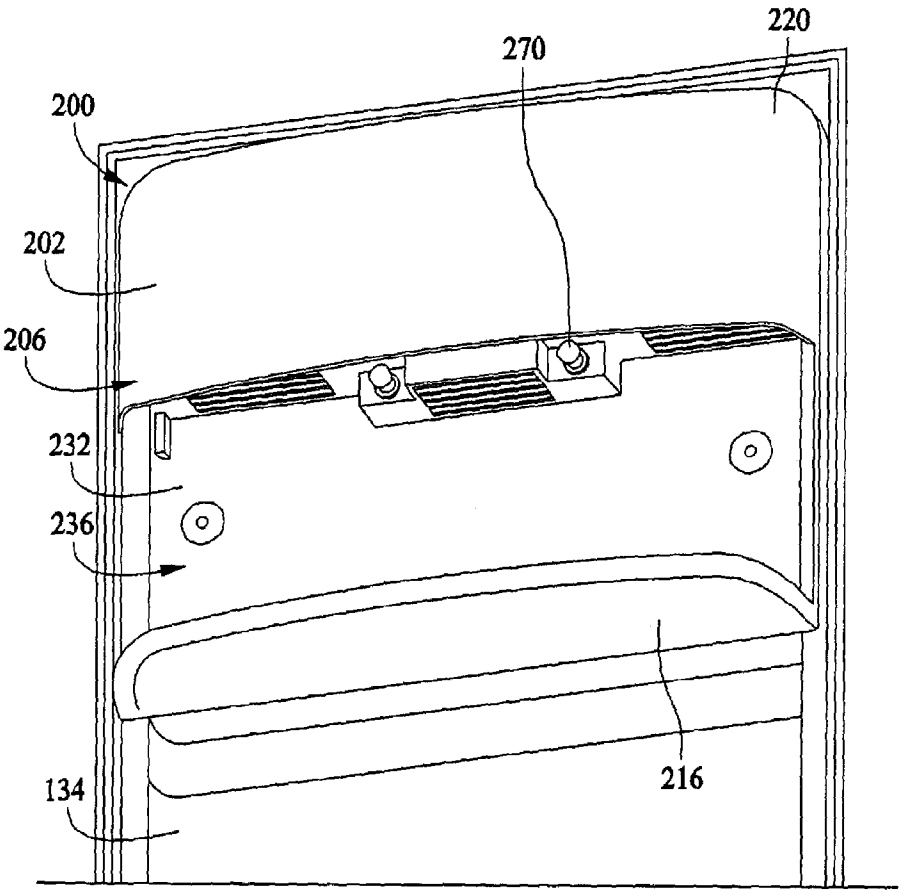
FIG. 5 is a perspective view of a lighting assembly for illumination of the storage compartment.

FIG. 5 is a perspective view of bin 200 (without bin door 204) having at least one light source 270 mounted to inner surface 236 of tray assembly 212 providing illumination of inner surface 236 of bin 200 and bin control interface 202. In the exemplary embodiment, a pair of direct current (DC) bulbs are mounted on inner surface 236 of top wall 230 of tray assembly 212. Light source 270 can turn on or off based on input with bin control interface 202 or the main refrigerator control interface 124.

Figure 6:
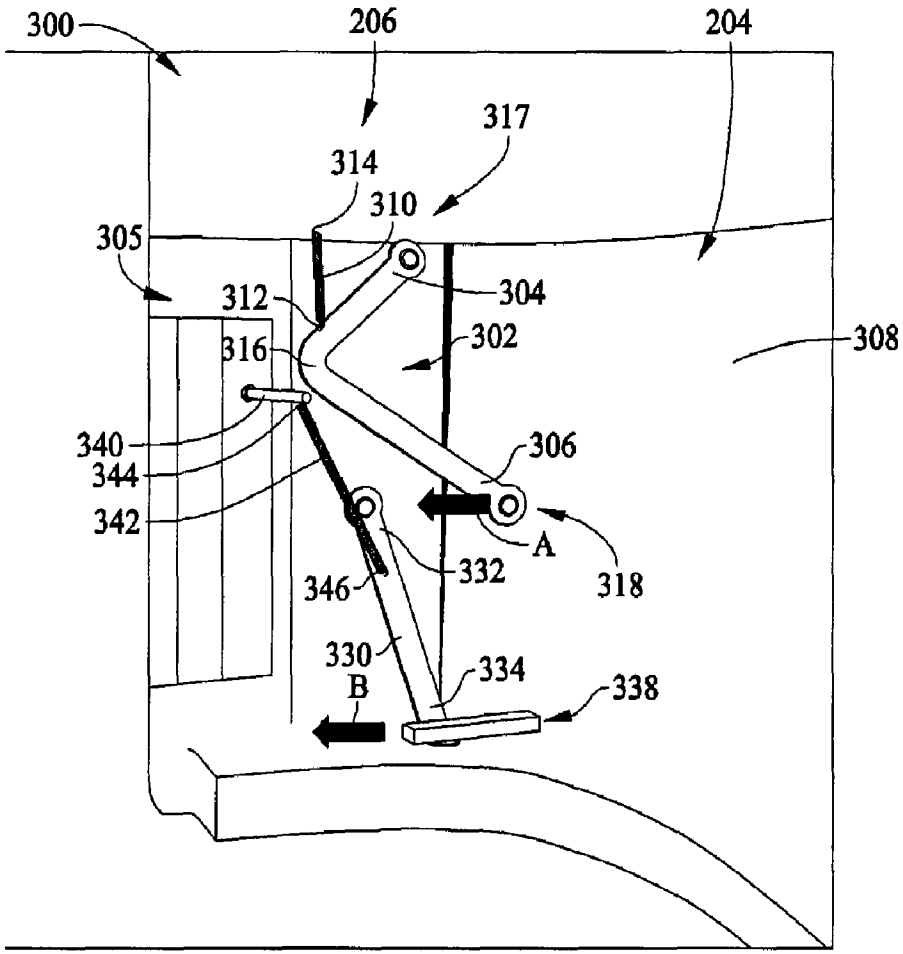
FIG. 6 is a perspective view of one embodiment of a linkage system for opening and closing a door to the storage compartment.

FIG. 6 illustrates a linkage system 300 coupled to front panel assembly 206 and bin door 204. Linkage system 300 includes a first linkage member 302 having a first end 304 pivotally connected to an inner surface 305 of front panel assembly 206 and a second end 306 pivotally connected to an inner surface 308 of bin door 204. A first biasing member 310 is coupled at a first end 312 to first linkage member 302 and a second end 314 is coupled to inner surface 305 of front panel assembly 206.

In the exemplary embodiment, first linkage member 302 is substantially v-shaped defining a corner 316. First end 304 is pivotally connected to an upper region 317 of inner surface 305 of front panel assembly 206. Second end 306 is pivotally connected to a center region 318 of inner surface 308 of bin door 204. First biasing member 310 has first end 312 coupled proximate to corner 316 of first linkage member 302 and second end 314 coupled to upper region 317 of inner surface 305 of front panel assembly 206.

Linkage system 300 further includes a second linkage member 330 having a first end 332 pivotally connected to inner surface 305 of front panel 206 and a second end 334 coupled to inner surface 308 of bin door 204. In the exemplary embodiment, second linkage member 330 is substantially elongate with first end 332 pivotally connected to a center region 336 of inner surface 305 of front panel 206 and a second end 334 is pivotally connected to a lower region 338 of bin door 204. Linkage system 300 further includes an anchor member 340, such as a fastener, extending from center region 336 of inner surface 305 of front panel assembly 206. A second biasing member 342 has a first end 344 coupled to anchor member 340 and a second end 346 coupled to second linkage member 330.

Linkage system 300 causes bin door 204 to rise vertically in a single plane between an open and a closed position without compromising the useable space within bin 200. Once a user provides an initial force to open or close bin door 204, first and second biasing members 310 and 342 of linkage system 300 cause bin door 204 to automatically move up or down without further application of force by the user. First and second biasing members 310 and 342 bias first and second linkage members 302 and 330 providing a closing force (represented by arrow A) at center region 318 and bottom region 338 (represented by arrow B) of bin door 204. In particular, the closing force at center region 318 will lead to a more balanced force and avoid gaps between bin door 204 and front panel assembly 206 when bin door 204 is in the closed position.

Linkage system 300 enables bin door 204 to be in the open position such that bin door 204 does not need to be held or supported by the user. In addition, fresh food door 134 may be open or closed with bin door 204 in either the open or closed position.

Figure 7:
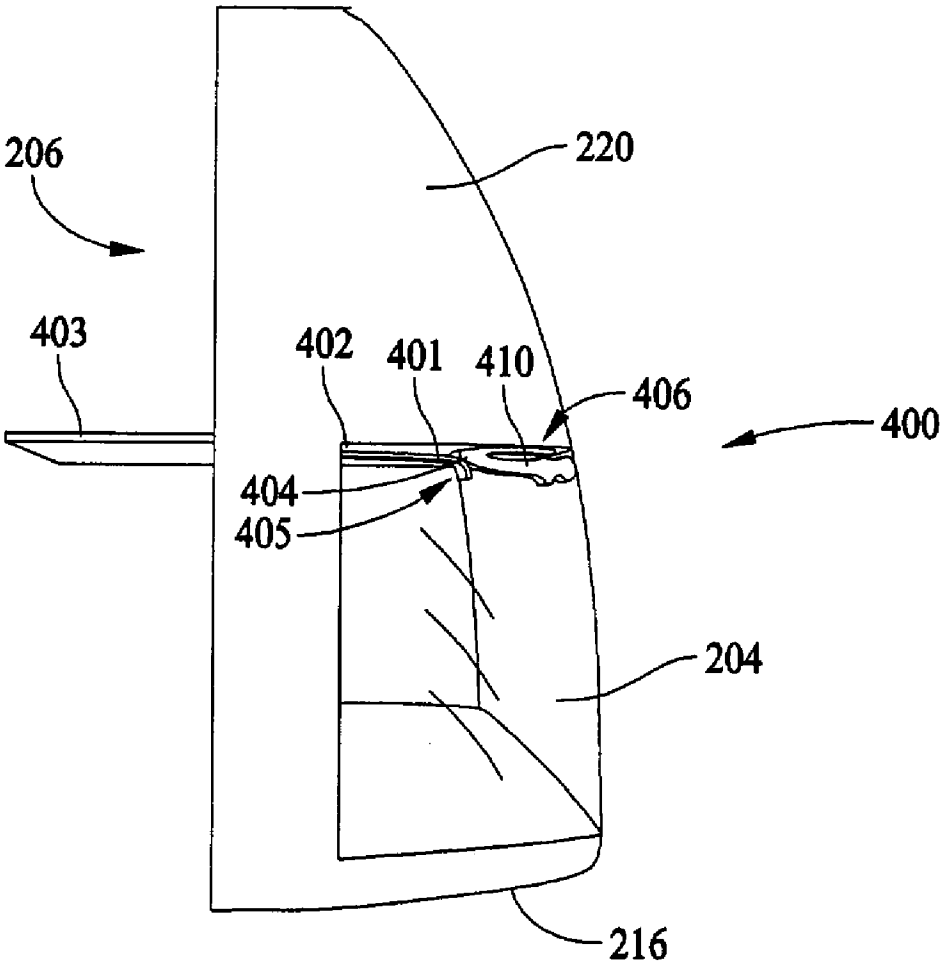
FIG. 7 is a side view of one embodiment of a leaf spring system with the door of the storage compartment in a closed position.
Figure 8:
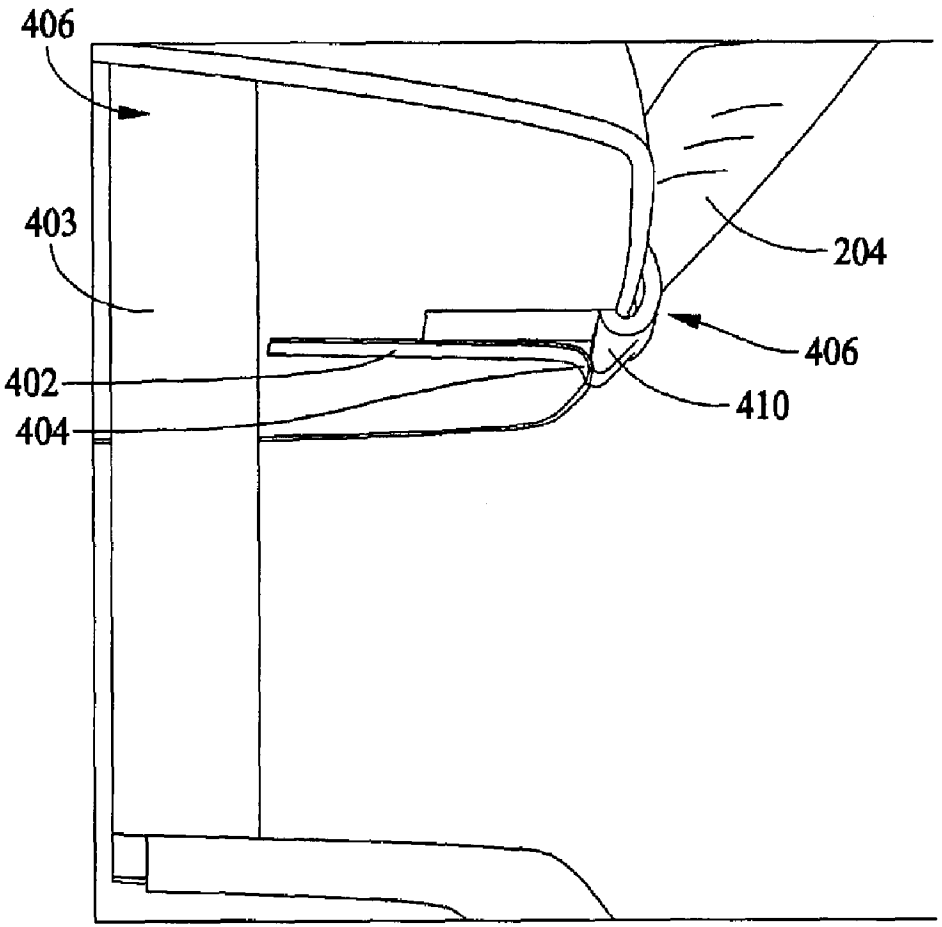
FIG. 8 is a perspective view of the leaf spring system with the door of the storage compartment in an open position.

FIG. 7 is a side view of a leaf spring system 400 including a leaf spring 401 includes a first end 402 fixedly attached to inner surface 236 of top wall 230 or a top support 403 of front panel assembly 206. Leaf spring 402 includes a second end 404 with a downward extending curved region 405 at a distal end thereof. Bin door 204 is coupled to top wall 230 of tray assembly 212 by a hinge 406. Hinge 406 has an arcuate hinge member 410 extending from hinge 406 and disposed between leaf spring and top support 403. As shown in FIG. 7, hinge member 410 is disposed between top support 403 and leaf spring 402 when bin door 204 is in the closed position. Hinge member 410 is in contact with leaf spring 402 and biases leaf spring 402 away from top wall 230. FIG. 8 shows hinge member 410 in contact with curved region 405 of leaf spring, thereby holding bin door 204 in the open position without external support.

Leaf spring system 400 causes bin door 204 to rise vertically in a single plane between an open and a closed position without compromising the useable space within bin 200. Once a user provides an initial force to close bin door 204, leaf spring 402 causes bin door 204 to automatically move down without a further application of a force by the user. Bin door 204 must be opened by the user and the leaf spring will hold it in the up position. As bin door 204 is moved from a closed position to an open position, hinge member 410 travels along leaf spring 402 towards curved region 405 of leaf spring 402. The combination of the shape of hinge member 410 and curved region 405 provide a substantially lateral force on hinge member 410, causing bin door 204 to stay in the open position without an external force. As bin door 204 is moved to the closed position, hinge member 410 travels away from curved region 405 of leaf spring 402. Leaf spring 402 applies a substantially upward force acting on hinge member 410 as hinge member 410 travels away from curved region 405 of leaf spring 402, thereby automatically closing bin door 204 without additional force by the user. In one embodiment, a latching mechanism (not shown) extends from support section 242 for keeping bin door 204 closed to prevent items in bin 200 from forcing bin door 204 open when the refrigerator door is opened or closed (as a result of the items shifting during motion of the refrigerator door).

As in linkage system 300, leaf spring system 400 enables bin door 204 to be in the open position such that bin door 204 does not need to be held or supported by the user. In addition, fresh food door 134 may be open or closed with bin door 204 in either the open or closed position.

Placing bin control interface 202 on front panel assembly 206 minimizes the wiring that has to be routed through a fresh food door hinge (not shown). Bin 200 uses various sensors and actuators to perform cooling and heating functions including thermistor(s) for sensing temperature, solid state thermoelectric device(s) for creating temperature differentials, fan(s) and damper(s) for circulating and directing air, as well as many switches and indicators for bin control interface 202. Typically, the opening in the door hinge (not shown) is quite small which means there is not enough room to pass through a large number of wires to connect the sensors, loads, and bin control interface 202 to main refrigerator control interface 124. Therefore, local (i.e. in the door) controls and control interface 202 are useful. Also, point of use controls add clarity of how to operate and are convenient for the user.

Figure 9:
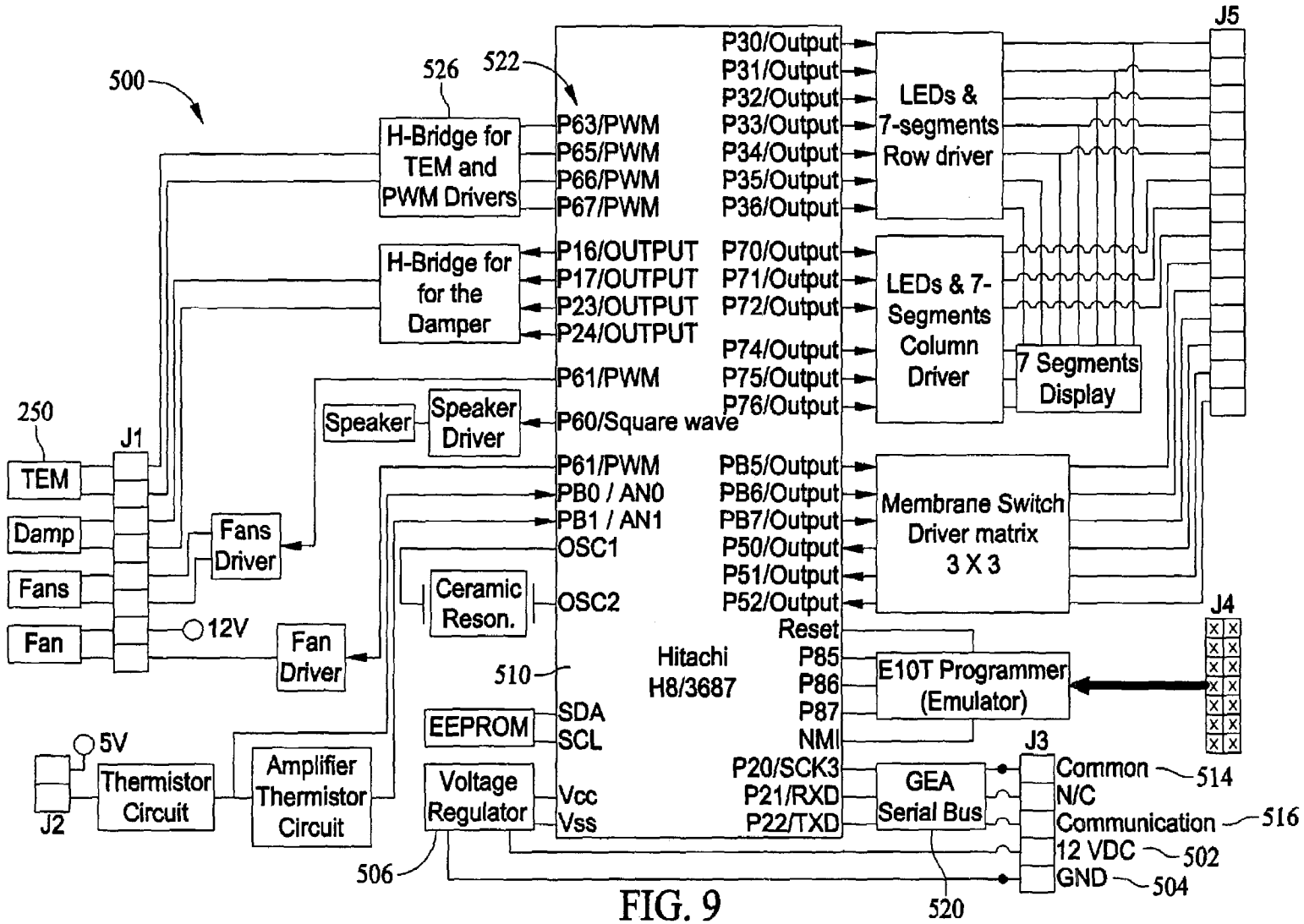
FIG. 9 is a block diagram for operating a temperature controlled compartment within refrigerator.

Bin 200 is completely self contained with its own local control and bin control interface 202. FIG. 9 is a block diagram 500 of a local control for bin 200. The only external connections which pass through the fresh food door hinge are two wires for the DC power supply and two wires for the communication interface (so the local control can communicate with main refrigerator control).

In the exemplary embodiment, DC power is supplied via 12 VDC wire 502 and a ground wire 504 electrically coupled to a voltage regulator 506 to a micro-processor chip 510. Communication interface has a common wire 514 and a communication wire 516 electrically coupled to a serial bus 520. In one embodiment, communication interface is a serial communication link conforming to a GE Appliances 1-wire serial communication protocol. 12 VDC, ground, common, and communication wires 502, 504, 514 and 516, respectively, are sized to fit through fresh food door hinge. In one embodiment, chip 510 is a Hitachi H8/3687. Chip 510 has four outputs 522 electrically coupled to an H-bridge 526 for TE module 250 and pulse width modulation (PWM) drivers, which controls temperature of bin 200.

Figure 10A:
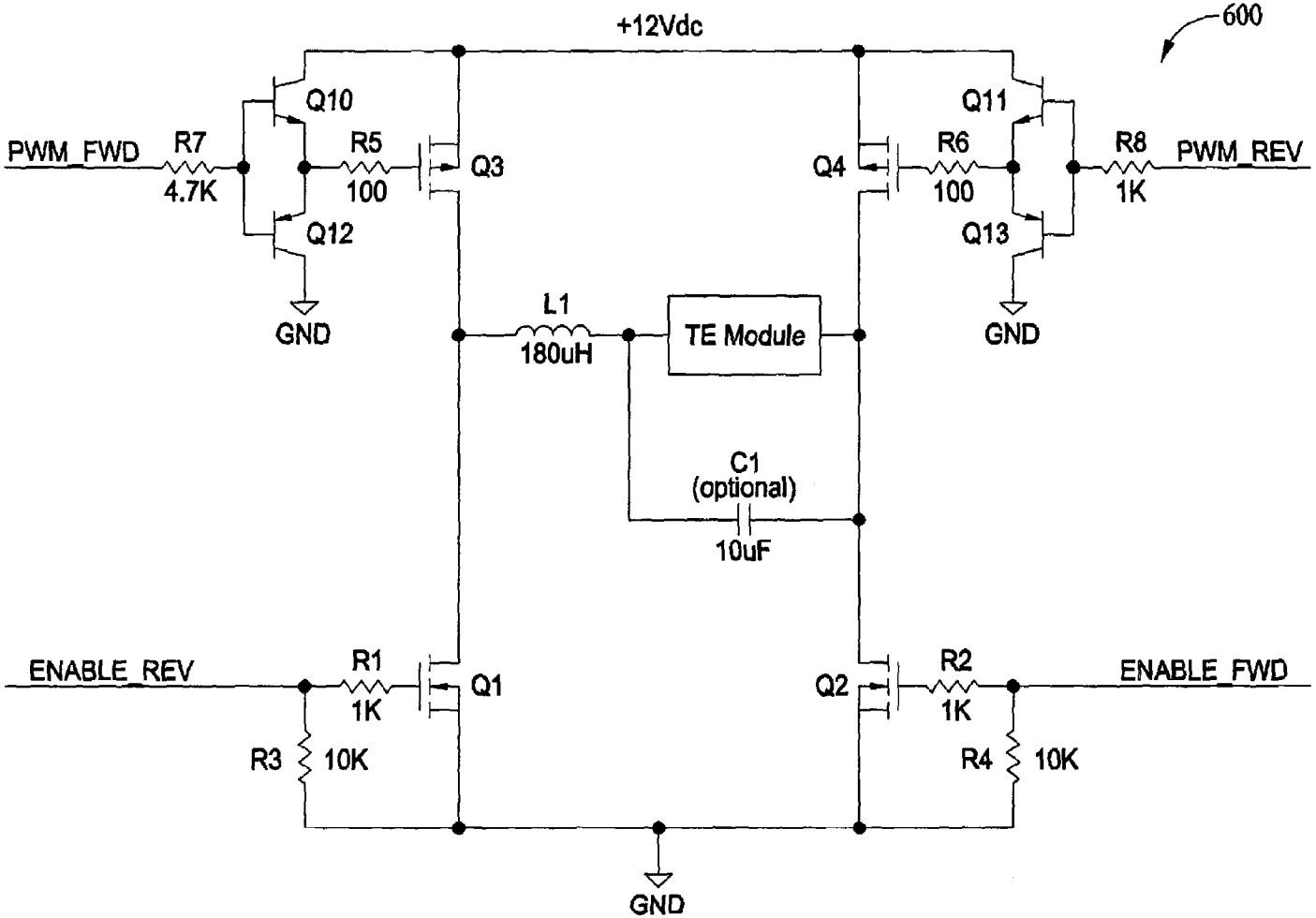
FIG. 10*a* is a block diagram of a pulse width modulation driver of a thermoelectric module control grid of FIG. 9.
Figure 10B:
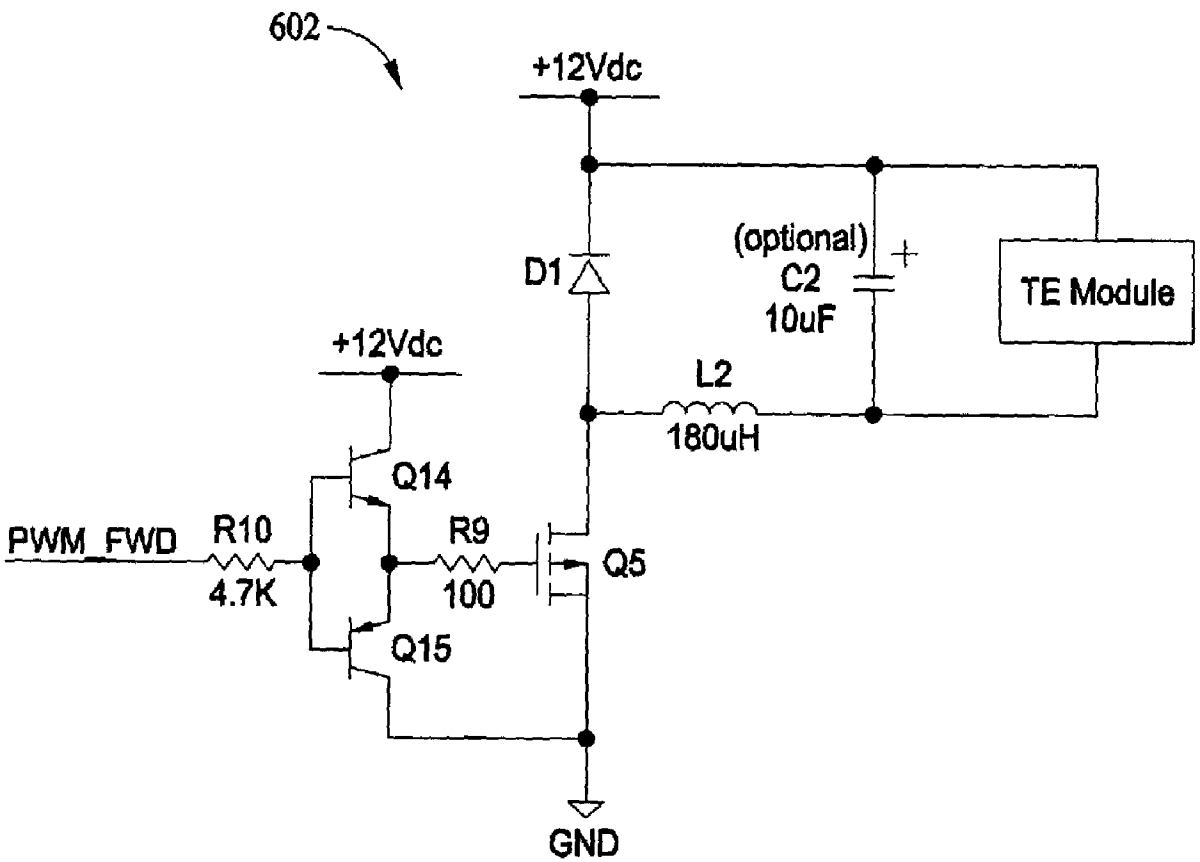
FIG. 10*b* is another embodiment of a block diagram of a unidirectional pulse width modulation driver of a thermoelectric module control grid of FIG. 9.

FIG. 10*a* is a block diagram of a TE module 250 PWM driver circuit 600. FIG. 10*b* is another embodiment of a block diagram of a unidirectional TE module 250 PWM driver circuit 602. Driver circuit 600 allows operation of at least one TE module 250 at varying voltages using PWM techniques. In one embodiment, fan 238 is controlled by PWM techniques for enhanced functionality. TE modules do not normally respond well to PWM operation, so a series choke (i.e. inductor) and optional shunt capacitor (not shown) is used to filter the modulated voltage such that TE module 250 operates efficiently at a plurality of voltages.

Heat removed from TE module 250 during the quick chill mode is dumped into fresh food compartment 102. Unfortunately, the thermal capacity of the refrigerator 100 to remove this heat is not infinite. Running TE module 250 at maximum power will in some cases exceed the sealed system's ability to remove this heat, causing a temperature rise in fresh food compartment 102 which will adversely affect performance. Efficiency of TE module 250 is also a strong function of applied voltage. Thus it is desirable to be able to regulate the output voltage to TE module 250 such that TE module 250 operates efficiently.

Driver circuit 602 utilizes an H-bridge circuit using 4 low-voltage MOSFETs connected between +12V and common DC rails. The drive circuits for the FETs are connected to output pins of a microcontroller with PWM capability. TE module 250 is connected between the midpoints of the upper and lower FETs. A choke rated to handle the appropriate DC current is placed in series with TE module 250 to absorb the AC component of the pulse width modulated voltage such that only the DC voltage is passed to TE module 250. In one embodiment, a shunt capacitor is placed in parallel with TE module 250 to aid the filtering. This capacitor is bipolar for a reversing driver as shown in FIG. 10*a*. In another embodiment, a non-reversing driver is used with one MOSFET and a polarized capacitor.

Passing only DC voltage to TE module 250 is useful. The maximum efficiency of TE module 250 is obtained at a fairly low voltage and capacity. Even though capacity of TE module 250 increases as voltage increases, the efficiency of decreases dramatically as the voltage is increased. Therefore, duty cycling TE module 250 at a high voltage does not achieve the same performance as operating at a lower voltage.

The performance of bin 200 is determined by the time it takes to cool items from room temperature to a desired chill temperature. Fresh food compartment 102 temperature impacts the cooling time. Local controls of bin 200 can send message(s) to the main refrigerator 100 control to lower the fresh food temperature, and delay any pending defrost cycle.

During a quick chill cycle, heat removed from bin 200 is dumped into fresh food compartment 102. This heat should be removed because fresh food air is circulated over hot side sink 256 of bin 200 heatsinks. If this air is heated, the difference in temperature achieved by TE module 250 would have to increase to compensate, requiring additional TE module 250 capacity. For the fastest chill times and the most cost effective use of TE module 250, it is desirable to keep the temperature of fresh food compartment 102 as cold as possible during a quick chill cycle.

When the user initiates a quick chill cycle, local control 500 of bin 200 sends a signal (i.e., a message) to the main refrigerator control interface 124. A first message delays the initiation of any pending defrost cycle that has not yet begun so that the defrost will not start until the quick chill cycle is complete. A second message engages maximum cooling capability for fresh food compartment 102. This is accomplished in several ways. For instance, the temperature setpoint is temporarily overwritten with the lowest possible setpoint, or the cooling system is commanded to run at maximum settings (compressor, evaporator and condenser fans, main damper, fresh food fan) until the cycle is complete. When the cycle is complete, local control 500 of bin 200 sends a message(s) to the main refrigerator control interface 124 to operate on normal mode (allowing defrost and restoring normal temperature settings). For the purpose of fail-safeness, the main refrigerator control interface 124 times out of the above overrides after some set amount of time, in case the restore messages from local control of bin 200 were lost or never sent. Also, if refrigerator 100 were already in defrost, it should not be terminated early as this will result in ice formation on the coils and lower the performance of the sealed system.

Bin 200 utilizes an area of the refrigerator 100 that has been shown to be low usage and allows the user to utilize the unused space and independently control the temperature of bin 200. Bin 200 also removes or reduces the need for using freezer compartment air and potential freezing issues.

While the invention has been described in terms of various specific embodiments, those skilled in the art will recognize that the invention can be practiced with modification within the spirit and scope of the claims.

What is claimed is:

1. A refrigerator comprising:

a refrigerator compartment;

a refrigerator door coupled to said refrigerator compartment, said refrigerator door including an inner surface;

a bin for storing items therein mounted to said inner surface of said refrigerator door; and at least one thermoelectric module operationally coupled to said bin such that said bin is temperature controlled independent of said refrigerator compartment.

2. A refrigerator according to claim 1, wherein said inner surface comprises a control interface thereon for controlling temperature within said bin.

3. A refrigerator according claim 2, wherein said control interface has a quick chill mode which causes a temperature within said bin to be maintained lower than a temperature within said compartment.

4. A refrigerator according to claim 2, wherein said control interface has a quick thaw mode which causes a temperature within said bin to be maintained higher than a temperature within said compartment.

5. A refrigerator according claim 2, wherein said control interface has a set temperature mode causing the temperature within said bin to be maintained at the set temperature inputted by a user.

6. A refrigerator according to claim 1, further comprising:

a first temperature sink coupled to a first side of said at least one thermoelectric module; and a second temperature sink coupled to a second side of said at least one thermoelectric module.

7. A refrigerator according to claim 1 wherein said bin comprises at least one light source to illuminate said bin.

8. A bin mounted to an inner surface of a refrigerator door, said bin comprising:

a bin housing assembly having a bottom wall, a side wall, and a top wall, defining an inner surface of said bin;

a bin door having an inner surface and an outer surface; and a linkage system coupling said bin door to said bin for moving said bin door between an open position and a closed position in a single vertical plane, said linkage system comprising:

a first linkage member comprising a first end coupled to said inner surface of said side wall and a second end coupled to said inner surface of said bin door;

a first biasing member comprising a first end coupled to said inner surface of said side wall and a second end coupled to said first linkage member;

a second linkage member comprising a first end coupled to said inner surface of said side wall and a second end coupled to said inner surface of said bin door; and a second biasing member including a first end coupled to an anchor member extending from said inner surface of said side wall and a second end coupled to said second linkage member.

9. A bin according to claim 8, wherein said linkage system automatically moves said bin door between the open position and the closed position when said bin door is provided with at least an initial upward force and downward force by a user.

10. A bin according to claim 8, wherein said refrigerator door is moveable between an open position and a closed position, said bin door is configured such that when said bin door is in the open position, the refrigerator is moveable between the open position and the closed position.

11. A bin mounted to an inner surface of a refrigerator door, said bin comprising:

a bin housing assembly having a bottom wall, a side wall, and a top wall defining an inner surface of said bin;

a bin door coupled to said bin housing assembly by a hinge; and a leaf spring system for moving said bin door between an open position and a closed position in a single vertical plane, said leaf spring system comprising:

a leaf spring including a first end fixedly attached to said inner surface of said top wall and a second end including a curved tip at a distal end thereof;

an arcuate hinge member extending from said hinge, said hinge member disposed between said leaf spring and said top wall so that said leaf spring applies a force on said hinge member.

12. A bin according to claim 11, wherein said leaf spring system automatically moves said bin door between the open position and the closed position when said bin door is provided with at least an initial upward force and downward force by a user.

13. A bin of claim 11, wherein said refrigerator door is moveable between an open position and a closed position, said bin door is configured such that when said bin door is in the open position, the refrigerator is moveable between the open position and the closed position.

14. A refrigerator comprising:

a refrigerator compartment;

a main refrigerator control system for controlling the temperature of said refrigerator compartment;

a refrigerator door coupled to said refrigerator compartment by a hinge, said refrigerator door including an inner surface; and a bin for storing items therein mounted to said inner surface of said refrigerator door, said bin is temperature controlled independently of said refrigerator compartment, said bin having a local bin control system for controlling the temperature within said bin, said local bin control system electrically coupled to said main refrigerator control system through said hinge.

15. A refrigerator of claim 14, wherein said local bin control system is electrically coupled to said main refrigerator control system by at least four wires.

16. A refrigerator of claim 15, wherein said at least four wires further comprise two direct current power supply wires and two communication interface wires.

17. A method for operating a thermoelectric module, said method comprising:

providing a pulse width modulation (PWM) controller, wherein the PWM controller comprises an H-bridge circuit;

electrically coupling a shunt capacitor to the thermoelectric module; and controlling the thermoelectric module with the PWM controller.

18. A refrigerator comprising:

a refrigerator compartment;

a main refrigerator control system for controlling the temperature of said refrigerator compartment;

a refrigerator door coupled to said refrigerator compartment by a hinge, said refrigerator door has an inner surface and an outer surface; and a bin for storing items therein mounted to said inner surface of said refrigerator door, said bin is temperature controlled independently of said refrigerator compartment, said bin having a local bin control system configured to control the temperature within said bin, said bin control systems configured to provide a signal to said main refrigerator control system.

19. A refrigerator according to claim 18 wherein said bin control system further configured to provide a signal to said main refrigerator control system to delay a defrost cycle in said refrigerator.

20. A refrigerator according to claim 18 wherein said bin control system further configured to provide a signal to said main refrigerator control system to decrease the temperature in said refrigerator compartment.

21. A refrigerator according to claim 19 wherein said bin control system further configured to provide a signal to said main refrigerator control system to resume normal operations in the refrigerator.

* * * * *